US011761373B1

(12) United States Patent
Kubo et al.

(10) Patent No.: US 11,761,373 B1
(45) Date of Patent: Sep. 19, 2023

(54) VEHICLE COOLING DEVICE

(71) Applicant: TOYOTA JIDOSHA KABUSHIKI KAISHA, Toyota (JP)

(72) Inventors: Masaya Kubo, Toyota (JP); Koji Ichikawa, Aichi-ken (JP); Takahiro Yoshida, Nagoya (JP); Takahiro Nishigaki, Nagoya (JP); Noriaki Kumagai, Toyota (JP); Sohichi Imai, Toyota (JP); Masahiro Noguchi, Handa (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/183,333

(22) Filed: Mar. 14, 2023

(30) Foreign Application Priority Data

Mar. 22, 2022 (JP) ..... 2022-045476

(51) Int. Cl.
*F01P 7/16* (2006.01)

(52) U.S. Cl.
CPC ..... *F01P 7/164* (2013.01); *F01P 2025/36* (2013.01); *F01P 2037/00* (2013.01); *F01P 2050/24* (2013.01)

(58) Field of Classification Search
CPC .... F01P 7/164; F01P 2025/36; F01P 2037/00; F01P 2050/24
See application file for complete search history.

(56) References Cited

U.S. PATENT DOCUMENTS

2017/0292435 A1* 10/2017 Toyama ..... F01P 7/04
2018/0100471 A1* 4/2018 Minami ..... F02B 29/0493

FOREIGN PATENT DOCUMENTS

| | | | |
|---|---|---|---|
| JP | 2007-154842 | A | 6/2007 |
| JP | 2008-202553 | A | 9/2008 |
| JP | 2012-21422 | A | 2/2012 |
| JP | 2013-79614 | A | 5/2013 |
| JP | 2016-200032 | A | 12/2016 |

* cited by examiner

*Primary Examiner* — Jacob M Amick
(74) *Attorney, Agent, or Firm* — Oblon, McClelland, Maier & Neustadt, L.L.P.

(57) ABSTRACT

A cooling device is employed in a vehicle including an internal combustion engine provided with a forced-induction device and an intercooler. The cooling device includes a circulation circuit configured to circulate coolant supplied to the intercooler, an electric pump configured to operate to circulate the coolant in the circulation circuit, and processing circuitry configured to control a discharge amount of the coolant of the pump. The processing circuitry is configured to execute a control amount deriving process of deriving a control amount of the pump based on a requested flow rate and a coolant temperature, and an operation process of causing the pump to operate based on the control amount when the requested flow rate is larger than 0.

4 Claims, 3 Drawing Sheets

VEHICLE COOLING DEVICE

BACKGROUND

1. Field

The present disclosure relates to a vehicle cooling device including a circulation circuit through which coolant supplied to an intercooler circulates.

2. Description of Related Art

A cooling device disclosed in Japanese Laid-Open Patent Publication No. 2013-79614 is a device used in a hybrid electric vehicle. The hybrid electric vehicle includes an internal combustion engine provided with a forced-induction device and an intercooler, a motor generator, and an inverter circuit for the motor generator. The cooling device includes a circulation circuit and an electric pump. The circulation circuit is configured to supply coolant to the intercooler and the inverter circuit. The coolant circulates through the circulation circuit. The electric pump is configured to operate to circulate the coolant in the circulation circuit.

In the cooling device described above, the pump may be caused to operate to cool the inverter circuit even when the temperature of the coolant is relatively low. When the coolant temperature is low, the viscosity of the coolant may become relatively high. When the viscosity of the coolant is relatively high, the flow rate of the coolant circulating through the circulation circuit may become lower than expected.

In a general aspect, a vehicle cooling device employed in a vehicle is provided. The vehicle includes an internal combustion engine provided with a forced-induction device and an intercooler configured to cool air supercharged by the forced-induction device. The vehicle cooling device includes a circulation circuit configured to circulate a coolant supplied to the intercooler, an electric pump configured to operate to circulate the coolant in the circulation circuit, and processing circuitry configured to control a discharge amount of the coolant of the pump. The processing circuitry is configured to execute a control amount deriving process and an operation process. The control amount deriving process is a process of deriving a control amount of the pump based on a requested flow rate and coolant temperature. The requested flow rate is a requested value of a flow rate of the coolant in the circulation circuit, and the coolant temperature which being a temperature of the coolant. The control amount deriving process includes deriving the control amount such that the control amount increases as the requested flow rate increases, and the control amount is larger when the coolant temperature is lower than a reference coolant temperature than when the coolant temperature is higher than or equal to the reference coolant temperature. The operation process is a process of causing the pump to operate based on the control amount when the requested flow rate is greater than 0.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, except for operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

Hereinafter, a vehicle cooling device 40 according to an embodiment will now be described with reference to FIGS. 1 to 3.

Figure 1:
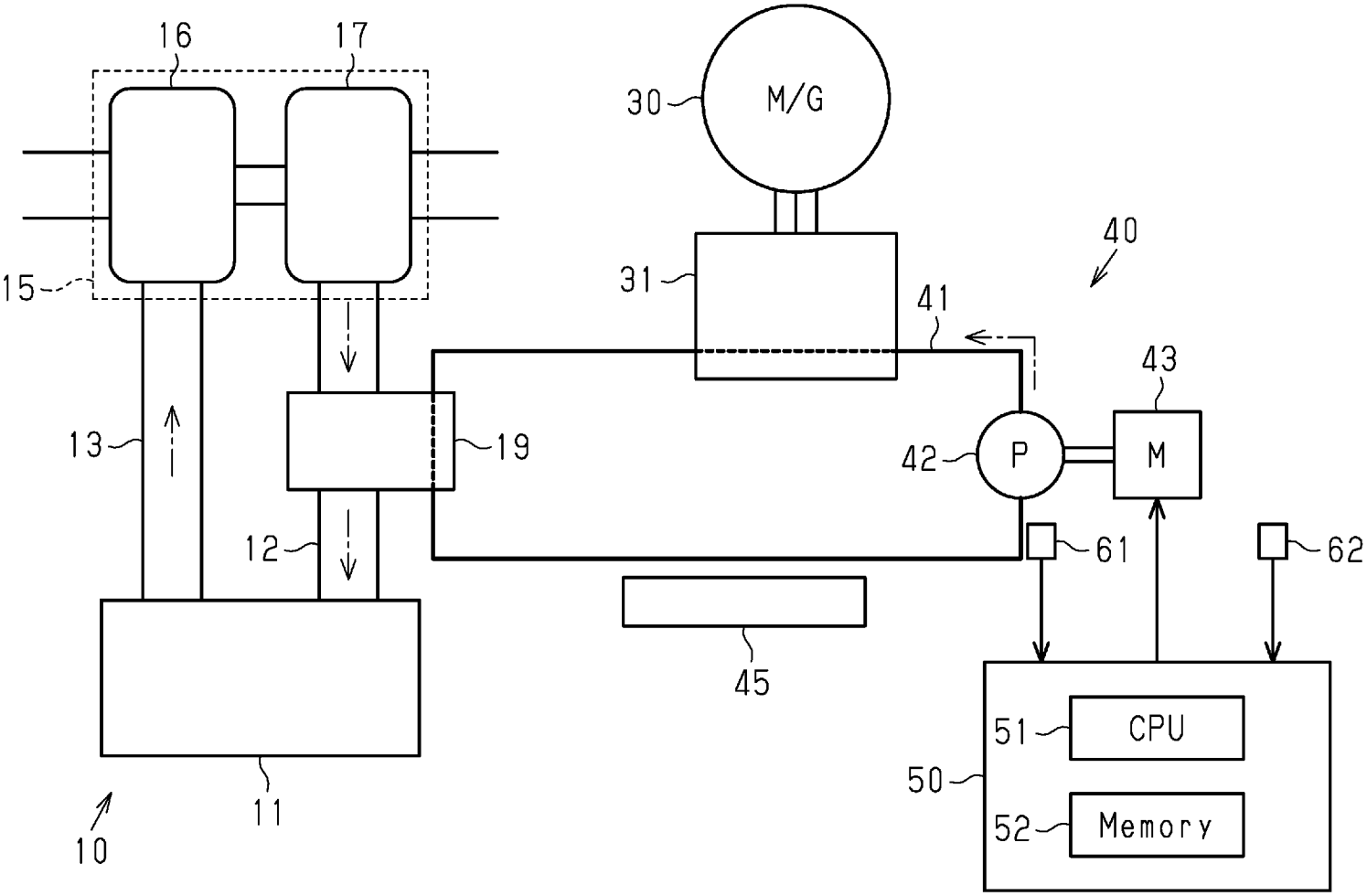
FIG. 1 is a configuration diagram illustrating a part of a configuration of a vehicle including a vehicle cooling device according to an embodiment.

FIG. 1 illustrates a part of a configuration of a vehicle including the vehicle cooling device 40. Hereinafter, the vehicle cooling device 40 will simply be referred to as a cooling device 40.

The vehicle is a hybrid electric vehicle including an internal combustion engine 10 and a motor generator 30 as drive sources. The vehicle includes an inverter circuit 31 for the motor generator 30. When the motor generator 30 functions as an electric motor, the inverter circuit 31 converts a DC voltage supplied from a vehicle on-board battery into an AC voltage and supplies the AC voltage to the motor generator 30. When the motor generator 30 functions as a generator, the inverter circuit 31 converts an AC voltage generated by the motor generator 30 into a DC voltage and supplies the DC voltage to the battery.

<Internal Combustion Engine>

The internal combustion engine 10 includes a combustion chamber 11, an intake passage 12, and an exhaust passage 13. The intake passage 12 is a passage through which air to be introduced into the combustion chamber 11 flows. In the combustion chamber 11, an air-fuel mixture containing fuel and air is combusted. The exhaust gas generated by the combustion of the air-fuel mixture in the combustion chamber 11 is discharged to the exhaust passage 13.

The internal combustion engine 10 is provided with a forced-induction device 15. The forced-induction device 15 includes a turbine 16 provided in the exhaust passage 13 and a compressor 17 provided in the intake passage 12. In the turbine 16, a turbine wheel is rotated by flow of exhaust gas flowing through the exhaust passage 13. Then, in the compressor 17, a compressor wheel rotates in synchronization with the rotation of the turbine wheel. As a result, the air supercharged by the compressor 17 flows through the intake passage 12.

The internal combustion engine 10 includes an intercooler 19 that cools the air supercharged by the forced-induction device 15. Specifically, the intercooler 19 is disposed in a portion of the intake passage 12 between the compressor 17 and the combustion chamber 11. The intercooler 19 is a water-cooled intercooler.

<Cooling Device>

The cooling device 40 includes a circulation circuit 41 in which coolant circulates, an electric pump 42 that operates to circulate the coolant in the circulation circuit 41, and a controller 50 that controls a discharge amount of the coolant of the pump 42. The pump 42 operates using a pump motor 43 as a drive source. The controller 50 controls the discharge amount of the coolant of the pump 42 by driving the pump motor 43.

The circulation circuit 41 is configured to supply the coolant to both the intercooler 19 and the inverter circuit 31. In the example shown in FIG. 1, the circulation circuit 41 is configured such that the coolant discharged from the pump 42 flows through the inverter circuit 31 and then flows through the intercooler 19. That is, the inverter circuit 31 and the intercooler 19 are arranged in series on the circulation circuit 41.

The coolant flowing through the circulation circuit 41 is cooled by a vehicle on-board radiator 45. In the example shown in FIG. 1, the coolant that has passed through the intercooler 19 and the inverter circuit 31 is cooled by the radiator 45 and then drawn into the pump 42 again.

Detection signals of various sensors are input to the controller 50. Examples of the sensors include a coolant temperature sensor 61 and a voltage sensor 62. The coolant temperature sensor 61 detects a coolant temperature TMPwt, which is a temperature of the coolant circulating in the circulation circuit 41. The voltage sensor 62 detects an applied voltage Vbt, which is a voltage supplied to the pump motor 43.

The controller 50 includes a CPU 51 and a memory 52. A control program executed by the CPU 51 is stored in the memory 52. The memory 52 also stores a flag FLG for determining which of a first control amount deriving process and a second control amount deriving process, which will be described below, is to be selected. Further, the memory 52 stores a first map used in the first control amount deriving process and a second map used in the second control amount deriving process. The flag FLG, the first map, and the second map will be discussed below.

<Processing for Operating Pump>

Figure 2:
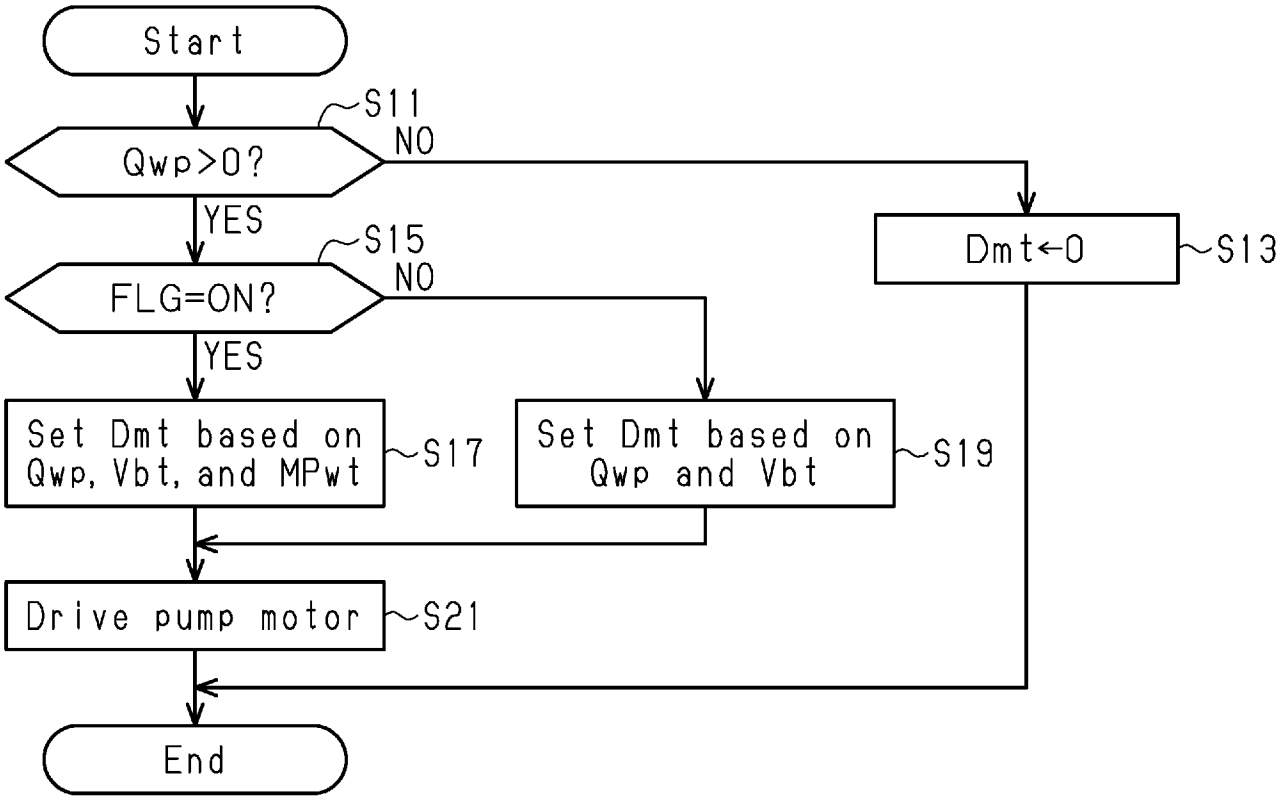
FIG. 2 is a flowchart showing a processing routine executed by a controller of the vehicle cooling device of FIG. 1 when causing the pump to operate.
Figure 3:
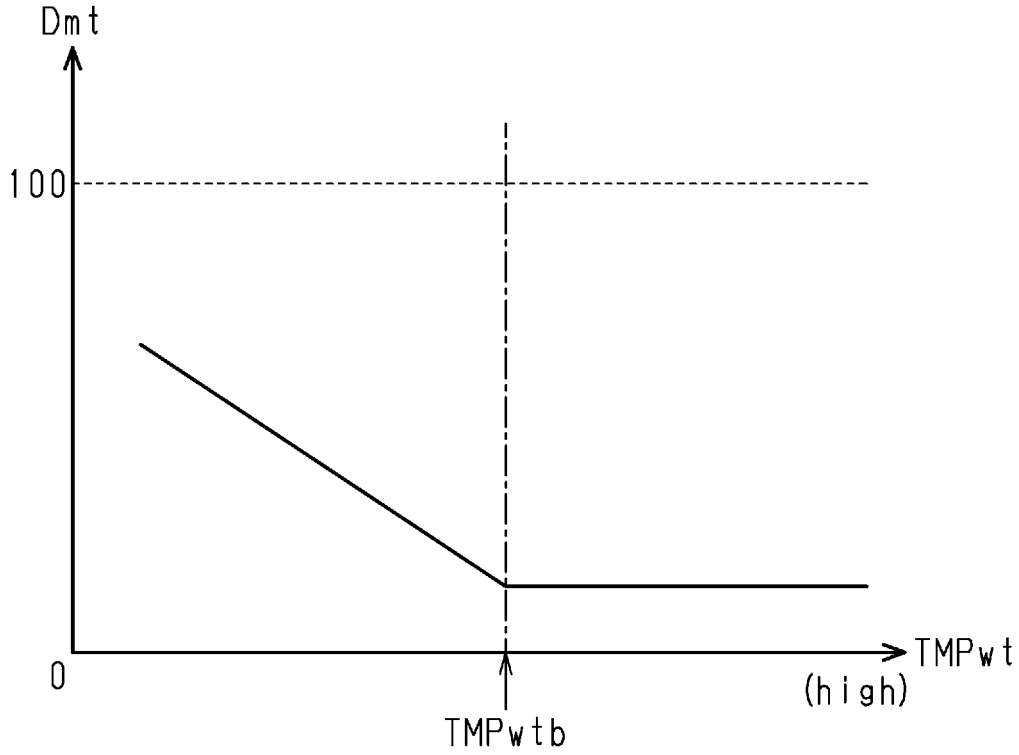
FIG. 3 is a diagram showing an example of a relationship between a coolant temperature and a drive duty cycle derived by the controller of FIG. 1.

Referring to FIGS. 2 and 3, a processing routine executed by the controller 50 when the pump 42 is caused to operate will be described. The controller 50 repeatedly executes this processing routine at specified control cycles.

In step S11 of this processing routine, the controller 50 acquires a requested flow rate Qwp and determines whether the requested flow rate Qwp is higher than 0. The requested flow rate Qwp is a requested value of the flow rate of the coolant in the circulation circuit 41. When the requested flow rate Qwp is 0, the controller 50 determines that there is no request for cooling the intercooler 19 and the inverter circuit 31. When the requested flow rate Qwp is higher than 0, the controller 50 determines that there is a cooling request for at least one of the intercooler 19 and the inverter circuit 31. When the requested flow rate Qwp is 0 (S11: NO), the controller 50 proceeds to the processing of step S13.

In step S13, the controller 50 sets a drive duty cycle Dmt, which is a duty cycle of the drive signal of the pump motor 43, to 0. As the drive duty cycle Dmt increases, the rotation speed of the pump motor 43 increases, and the flow rate of the coolant in the circulation circuit 41 increases. In the present embodiment, the drive duty cycle Dmt corresponds to a control amount of the pump 42. When the drive duty cycle Dmt is set to 0, the controller 50 temporarily ends the processing routine. That is, when the drive duty cycle Dmt is 0, the controller 50 does not cause the pump 42 to operate.

When the requested flow rate Qwp is higher than 0 in step S11 (YES), the controller 50 proceeds to the process of step S15. In step S15, the controller 50 reads the flag FLG from the memory 52, and determines whether or not the flag FLG is set to ON. The flag FLG is a flag indicating whether the vehicle is a hybrid electric vehicle including both an internal combustion engine and a motor generator as drive sources or a conventional vehicle including only an internal combustion engine as a drive source. When the flag FLG is set to ON, the controller 50 determines that the vehicle is a hybrid electric vehicle. When flag FLG is set to OFF, the controller 50 determines that the vehicle is a conventional vehicle.

The hybrid electric vehicle having the inverter circuit 31 may travel by driving the motor generator 30 while stopping the operation of the internal combustion engine 10. Therefore, in a hybrid electric vehicle, when the coolant temperature TMPwt is relatively low, cooling of the intercooler 19 may not be requested, but cooling of the inverter circuit 31 may be requested. In contrast, in a conventional vehicle that does not include the inverter circuit 31, when the coolant temperature TMPwt is relatively low, cooling of the intercooler 19 is not requested. This is because when the coolant temperature TMPwt is relatively low, the warm-up operation of the engine 10 has not yet been completed, and therefore it is not requested to lower the temperature of the air introduced into the combustion chamber 11. That is, in the conventional vehicle, when the coolant temperature TMPwt is lower than a reference coolant temperature TMPwtb, the operation of the pump 42 is not requested. In the hybrid electric vehicle, the operation of the pump 42 may be requested even when the coolant temperature TMPwt is lower than the reference coolant temperature TMPwtb. Therefore, the flag FLG corresponds to information regarding whether or not to operate the pump 42 even when the coolant temperature TMPwt is lower than the reference coolant temperature TMPwtb. The memory 52 storing the flag FLG also functions as an information storage unit. In the present embodiment, since the vehicle is a hybrid electric vehicle, the flag FLG is set to ON.

If the flag FLG is set to ON in step S15 (YES), the controller 50 proceeds to the processing in step S17. In step S17, the controller 50 derives the drive duty cycle Dmt based on the requested flow rate Qwp, the applied voltage Vbt, and the coolant temperature TMPwt. In the present embodiment, the controller 50 refers to a first map stored in the memory 52 and derives a value corresponding to the requested flow rate Qwp, the applied voltage Vbt, and the coolant temperature TMPwt as the drive duty cycle Dmt.

The first map is a map for the controller 50 to derive the drive duty cycle Dmt based on the requested flow rate Qwp, the applied voltage Vbt, and the coolant temperature TMPwt. By referring to the first map, the controller 50 derives a larger value as the drive duty cycle Dmt as the requested flow rate Qwp increases. Further, the controller 50 derives a larger value as the drive duty cycle Dmt as the applied voltage Vbt decreases. Further, the controller 50 changes the drive duty cycle Dmt according to the coolant temperature TMPwt.

FIG. 3 shows a relationship between the coolant temperature TMPwt and the drive duty cycle Dmt derived by the controller 50 under the condition that the requested flow rate Qwp and the applied voltage Vbt are constant. As shown in FIG. 3, under such conditions, the controller 50 derives a larger value as the drive duty cycle Dmt when the coolant temperature TMPwt is lower than the reference coolant temperature TMPwtb than when the coolant temperature TMPwt is equal to or higher than the reference coolant temperature TMPwtb. This is because when the coolant temperature TMPwt is lower than the reference coolant temperature TMPwtb, the viscosity of the coolant varies depending on the coolant temperature TMPwt. To be more specific, the lower the coolant temperature TMPwt, the higher the viscosity of the coolant becomes. When the viscosity of the coolant is high, it becomes difficult for the coolant to flow in the circulation circuit 41, and thus the flow rate of the coolant in the circulation circuit 41 tends to be lower than expected. Therefore, the controller 50 derives a larger value as the drive duty cycle Dmt when the coolant temperature TMPwt is lower than the reference coolant temperature TMPwtb than when the coolant temperature TMPwt is equal to or higher than the reference coolant temperature TMPwtb. More specifically, when the coolant temperature TMPwt is lower than the reference coolant temperature TMPwtb, the controller 50 derives a larger value as the drive duty cycle Dmt as the coolant temperature TMPwt decreases.

Referring back to FIG. 2, when the drive duty cycle Dmt is derived in this way, the controller 50 proceeds to the processing of step S21.

When flag FLG is set to OFF in step S15 (NO), controller 50 proceeds to the process of step S19. In step S19, the controller 50 derives the drive duty cycle Dmt based on the requested flow rate Qwp and the applied voltage Vbt. That is, the controller 50 derives the drive duty cycle Dmt without considering the coolant temperature TMPwt. Deriving the drive duty cycle Dmt without considering the coolant temperature TMPwt means that the drive duty cycle Dmt is not changed in accordance with the coolant temperature TMPwt. In the present embodiment, the controller 50 refers to the second map stored in the memory 52 and derives a value corresponding to the requested flow rate Qwp and the applied voltage Vbt as the drive duty cycle Dmt.

The second map is a map for the controller 50 to derive the drive duty cycle Dmt based on the requested flow rate Qwp and the applied voltage Vbt. By referring to the second map, the controller 50 derives a larger value as the drive duty cycle Dmt as the requested flow rate Qwp increases. Further, the controller 50 derives a larger value as the drive duty cycle Dmt as the applied voltage Vbt decreases. When the drive duty cycle Dmt is derived in this way, the controller 50 proceeds to the processing of step S21.

In step S21, the controller 50 drives the pump motor 43 based on the drive duty cycle Dmt derived in step S17 or step S19. That is, the controller 50 drives the pump 42 such that the discharge amount of the coolant increases as the drive duty cycle Dmt increases. Thereafter, the controller 50 temporarily ends the present processing routine.

The process of step S17 is a process of deriving the drive duty cycle Dmt based on the requested flow rate Qwp and the coolant temperature TMPwt. The process of step S19 is a process of deriving the drive duty cycle Dmt based on only the requested flow rate Qwp, which is one of the requested flow rate Qwp and the coolant temperature TMPwt. Therefore, in the present embodiment, step S17 corresponds to a first control amount deriving process, and step S19 corresponds to a second control amount deriving process. Step S21 corresponds to an operation process for causing the pump 42 to operate based on the drive duty cycle Dmt when the requested flow rate Qwp is higher than 0. The memory 52 that stores the first map also functions as a map storage unit.

Operation and Advantages of Present Embodiment

The vehicle cooling device 40 according to the present embodiment is used in the vehicle, which includes the internal combustion engine 10 provided with the forced-induction device 15 and the intercooler 19 configured to cool air supercharged by the forced-induction device 15. The vehicle cooling device 40 includes the circulation circuit 41 configured to circulate the coolant supplied to the intercooler 19, the electric pump 42 configured to operate to circulate the coolant in the circulation circuit 41, and the controller 50 configured to control the discharge amount of the coolant of the pump 42. The controller 50 is configured to execute the control amount deriving process (step S17) and the operation process (step S21). The control amount deriving process (step S17) is a process of deriving the control amount (drive duty cycle Dmt) of the pump 42 based on the requested flow rate Qwp, which is the requested value of the flow rate of the coolant in the circulation circuit 41, and the coolant temperature TMPwt, which is the temperature of the coolant. The control amount deriving process (step S17) includes deriving the control amount (drive duty cycle Dmt) such that the control amount (drive duty cycle Dmt) increases as the requested flow rate Qwp increases, and the control amount (drive duty cycle Dmt) is larger when the coolant temperature TMPwt is lower than the reference coolant temperature TMPwtb than when the coolant temperature TMPwt is equal to or higher than the reference coolant temperature TMPwtb. The operation process (step S21) is a process of causing the pump 42 to operate based on the control amount (drive duty cycle Dmt) when the requested flow rate Qwp is larger than 0.

The vehicle cooling device 40 according to the present embodiment derives, as the drive duty cycle Dmt, a value obtained by taking into consideration the coolant temperature TMPwt. To be more specific, a larger value is derived as the drive duty cycle Dmt when the coolant temperature TMPwt is lower than the reference coolant temperature TMPwtb than when the coolant temperature TMPwt is equal to or higher than the reference coolant temperature TMPwtb. The discharge amount of the coolant of the pump 42 is controlled based on the drive duty cycle Dmt. Thus, the actual flow rate of the coolant circulating through the circulation circuit 41 and the requested flow rate are less likely to deviate from each other even when the coolant is less likely to flow through the circulation circuit 41 because the coolant temperature TMPwt is low and the viscosity of the coolant is high. Therefore, when the pump 42 is operated in a situation where the coolant temperature TMPwt is low, it is possible to prevent the flow rate of the coolant circulating through the circulation circuit 41 from becoming smaller than expected. As a result, it is possible to suppress a decrease in the cooling efficiency of the cooling target by the coolant. In the present embodiment, the intercooler 19 and the inverter circuit 31 are objects to be cooled by the coolant.

In the present embodiment, the following advantages are obtained.

(1) The vehicle according to the present embodiment is a hybrid electric vehicle including the motor generator 30 and the inverter circuit 31 for the motor generator 30. The circulation circuit 41 is configured to supply the coolant to both the intercooler 19 and the inverter circuit 31 by the operation of the pump 42. The controller 50 is configured to cause the pump 42 to operate also when cooling of the inverter circuit 31 is requested. The vehicle according to the present embodiment can travel by driving the motor generator 30 even in a state in which the operation of the internal combustion engine 10 is stopped. Therefore, even when the coolant temperature TMPwt is low, the coolant may be circulated in the circulation circuit 41 to cool the inverter circuit 31. In the present embodiment, when the coolant temperature TMPwt is lower than the reference coolant temperature TMPwtb and cooling of the inverter circuit 31 is requested, the pump 42 is caused to operate. At this time, a value obtained by taking into consideration the coolant temperature TMPwt is derived as the drive duty cycle Dmt. Therefore, by causing the pump 42 to operate based on the drive duty cycle Dmt, a sufficient amount of coolant is supplied to the inverter circuit 31. Therefore, it is possible to suppress a decrease in the cooling efficiency of the inverter circuit 31.

(2) The controller 50 includes the map storage unit (the memory 52) configured to store a map indicating a relationship between the requested flow rate Qwp, the coolant temperature TMPwt, and the control amount. The controller 50 is configured to derive the control amount (drive duty cycle Dmt) corresponding to the requested flow rate Qwp and the coolant temperature TMPwt by referring to the map in the control amount deriving process. The control amount deriving process is a first control amount deriving process (step 17). The controller 50 includes an information storage unit (memory 52) configured to store information (flag FLG) regarding whether or not to operate the pump 42 even when the coolant temperature TMPwt is lower than the reference coolant temperature TMPwtb. The controller 50 is configured to execute the first control amount deriving process (step S17) when the information (flag FLG) stored in the information storage unit (memory 52) indicates that the pump 42 is caused to operate even if the coolant temperature TMPwt is lower than the reference coolant temperature TMPwtb, and execute the second control amount deriving process (step S19) when the information (flag FLG) stored in the information storage unit (memory 52) indicates that the pump 42 is not caused to operate if the coolant temperature TMPwt is lower than the reference coolant temperature TMPwtb. The second control amount deriving process (step S19) is a process of deriving the control amount (drive duty cycle Dmt) based on only the requested flow rate Qwp out of the requested flow rate Qwp and the coolant temperature TMPwt.

A comparative example will now be considered in which the controller 50 refers to the second map instead of the first map in step S17. In this comparative example, the controller 50 derives a value corresponding to the requested flow rate Qwp and the applied voltage Vbt as the reference duty cycle by referring to the second map. Further, the controller 50 derives a compensation value corresponding to the coolant temperature TMPwt in order to supply a sufficient amount of coolant to the inverter circuit 31 regardless of the coolant temperature TMPwt. At this time, the controller 50 derives a larger value as the compensation value when the coolant temperature TMPwt is lower than the reference coolant temperature TMPwtb than when the coolant temperature TMPwt is equal to or higher than the reference coolant temperature TMPwtb. Then, the controller 50 derives the sum of the reference duty cycle and the correction amount as the drive duty cycle Dmt. Even in this case, when the viscosity of the coolant becomes high due to the low coolant temperature TMPwt, the deviation between the actual flow rate of the coolant and the requested flow rate is suppressed to some extent. However, in order to minimize the difference between the actual flow rate of the coolant and the requested flow rate, the method using such a correction value is not sufficient.

In this regard, in the present embodiment, the drive duty cycle Dmt is derived with reference to the first map. The first map is created by performing experiments and simulations so that the controller 50 referring to the first map can derive the drive duty cycle Dmt at which the difference between the actual flow rate of the coolant and the requested flow rate becomes as small as possible based on the requested flow rate Qwp, the applied voltage Vbt, and the coolant temperature TMPwt. Therefore, by driving the pump motor 43 using the drive duty cycle Dmt derived by the controller 50 with reference to the first map, the deviation between the actual flow rate of the coolant and the requested flow rate is less likely to occur than in the case of the comparative example described above.

<Modifications>

The above-described embodiment may be modified as follows. The above-described embodiment and the following modifications can be combined with each other if there is no technical contradiction.

Figure 4:
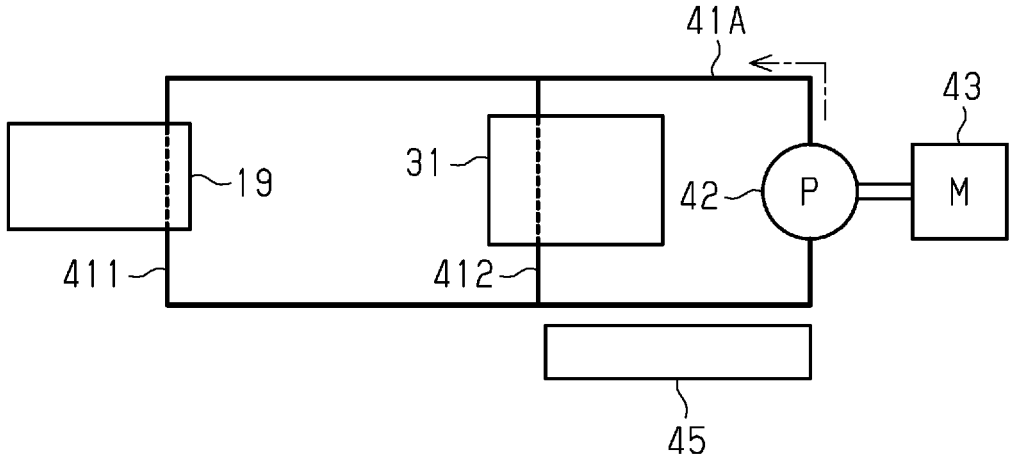
FIG. 4 is a schematic diagram showing a modification of the circulation circuit provided in the vehicle cooling device of FIG. 1.

If the coolant discharged by the pump 42 can be supplied to both the intercooler 19 and the inverter circuit 31, the circulation circuit may have a configuration different from that of the circulation circuit 41 illustrated in FIG. 1. FIG. 4 shows a modified circulation circuit 41A. The circulation circuit 41A is configured such that the intercooler 19 and the inverter circuit 31 are arranged in parallel. That is, the circulation circuit 41 includes a first passage 411, through which the coolant supplied to the intercooler 19 flows, and a second passage 412, through which the coolant supplied to the inverter circuit 31 flows. Even in this case, the pump 42 can supply the coolant to both the intercooler 19 and the inverter circuit 31.

In a case in which cooling of the intercooler 19 is requested even when the coolant temperature TMPwt is lower than the reference coolant temperature TMPwtb, the circulation circuit 41 may be configured not to supply coolant to the inverter circuit 31. In this case, the vehicle may be a conventional vehicle that does not include motor generator 30 as a drive source.

The controller 50 may refer to the second map instead of the first map when deriving the drive duty cycle Dmt. In this case, the controller 50 derives a value corresponding to the requested flow rate Qwp and the applied voltage Vbt as the reference duty cycle by referring to the second map. Further, the controller 50 derives a compensation value corresponding to the coolant temperature TMPwt. At this time, the controller 50 derives a larger value as the compensation value when the coolant temperature TMPwt is lower than the reference coolant temperature TMPwtb than when the coolant temperature TMPwt is equal to or higher than the reference coolant temperature TMPwtb. Then, the controller 50 derives the sum of the reference duty cycle and the correction amount as the drive duty cycle Dmt. Even in this case, the actual flow rate of the coolant and the requested flow rate are prevented from deviating from each other to some extent even when the viscosity of the coolant becomes high because the coolant temperature TMPwt is relatively low.

The vehicle according to the above embodiment is a hybrid electric vehicle. Therefore, the processing routine shown in FIG. 2 may omit the processing of step S15 and the processing of step S19. In this case, the second map does not necessarily need to be stored in the memory 52, and the flag FLG does not necessarily need to be stored in the memory 52.

The controller 50 is not limited to a device that includes a CPU and a ROM and executes software processing. That is, the controller 50 may be processing circuitry that includes any one of the following configurations (a) to (c).

(a) Circuitry including one or more processors that execute at least one of various processes according to computer programs (software). The processor includes a CPU and a memory such as RAM and ROM. The memory stores program codes or instructions configured to cause the CPU to execute processes. The memory, which is a computer-readable medium, includes any type of media that are accessible by general-purpose computers and dedicated computers.

(b) One or more dedicated hardware circuits that execute at least part of various processes. The dedicated hardware circuits include, for example, an application specific integrated circuit (ASIC) and a field programmable gate array (FPGA).

(c) One or more processors that execute part of various processes according to programs and one or more dedicated hardware circuits that execute the remaining processes.

What is claimed is:

1. A vehicle cooling device employed in a vehicle, wherein the vehicle includes an internal combustion engine provided with a forced-induction device and an intercooler configured to cool air supercharged by the forced-induction device, and the vehicle cooling device comprises:

a circulation circuit configured to circulate a coolant supplied to the intercooler;

an electric pump configured to operate to circulate the coolant in the circulation circuit; and processing circuitry configured to control a discharge amount of the coolant of the pump, the processing circuitry is configured to execute a control amount deriving process and an operation process, and the control amount deriving process is a process of deriving a control amount of the pump based on a requested flow rate and coolant temperature, the requested flow rate being a requested value of a flow rate of the coolant in the circulation circuit, and the coolant temperature which being a temperature of the coolant, the control amount deriving process includes deriving the control amount such that the control amount increases as the requested flow rate increases, and the control amount is larger when the coolant temperature is lower than a reference coolant temperature than when the coolant temperature is higher than or equal to the reference coolant temperature, and the operation process is a process of causing the pump to operate based on the control amount when the requested flow rate is greater than 0.

2. The vehicle cooling device according to claim 1, wherein the vehicle is a hybrid electric vehicle including a motor generator and an inverter circuit for the motor generator, the circulation circuit is configured to supply the coolant to both of the intercooler and the inverter circuit by operation of the pump, and the processing circuitry is configured to cause the pump to operate when cooling of the inverter circuit is requested.

3. The vehicle cooling device according to claim 1, wherein the processing circuitry is configured to store a map representing a relationship between the requested flow rate, the coolant temperature, and the control amount, and the processing circuitry is configured to derive the control amount that corresponds to the requested flow rate and the coolant temperature by referring to the map in the control amount deriving process.

4. The vehicle cooling device according to claim 1, wherein the control amount deriving process is a first control amount deriving process, the processing circuitry stores information on whether to cause the pump to operate even when the coolant temperature is lower than the reference coolant temperature, and the processing circuitry is configured to execute the first control amount deriving process in a case in which the information stored in the processing circuitry is information indicating that the pump is caused to operate even when the coolant temperature is lower than the reference coolant temperature, and a second control amount deriving process in a case in which the information stored in the processing circuitry is information indicating that the pump is not caused to operate when the coolant temperature is lower than the reference coolant temperature, and the second control amount deriving process is a process of deriving the control amount based on only the requested flow rate, which is one of the requested flow rate and the coolant temperature.

* * * * *